US006409542B1

(12) United States Patent
Ivey, Jr. et al.

(10) Patent No.: US 6,409,542 B1
(45) Date of Patent: Jun. 25, 2002

(54) ELECTRICALLY SHIELDED CONNECTOR WITH OVER-MOLDED INSULATING COVER

(75) Inventors: James W. Ivey, Jr., Wendell, NC (US); Keith Bass, Redding, CA (US)

(73) Assignee: Alcatel, societe anonyme (FR)

( * ) Notice: Subject to any disclaimer, the term of this patent is extended or adjusted under 35 U.S.C. 154(b) by 0 days.

(21) Appl. No.: 09/812,080

(22) Filed: Mar. 19, 2001

(51) Int. Cl.[7] ..... H01R 13/648; H01R 13/42
(52) U.S. Cl. ..... 439/607; 439/738
(58) Field of Search ..... 439/607, 608, 439/609, 610, 676, 541.5, 738, 901, 447, 404

(56) References Cited

U.S. PATENT DOCUMENTS 4,653,825 A * 3/1987 Olsson ..... 439/295
4,707,045 A * 11/1987 Ney et al. ..... 439/252
4,786,260 A * 11/1988 Spaulding ..... 29/861
5,055,070 A * 10/1991 Plegge et al. ..... 439/609
5,236,375 A * 8/1993 Kachlic ..... 439/607
5,480,327 A * 1/1996 Zola ..... 439/445
6,257,920 B1 * 7/2001 Finona et al. ..... 439/455

* cited by examiner

*Primary Examiner*—Brian Sircus
*Assistant Examiner*—Chandrika Prasad
(74) *Attorney, Agent, or Firm*—Simon, Galasso & Frantz, PLC; V. Lawrence Sewell; Craig A. Hoersten

(57) ABSTRACT

One embodiment of a shielded cable assembly as disclosed herein includes a connector body including a wire attachment region. A contact member, including a wire attachment portion, is mounted on the connector body with the wire attachment portion positioned adjacent to the wire attachment region of the connector body. An insulating insert, including a wire-receiving region, is positioned adjacent to the connector body with at least a portion of the wire attachment region of the connector body extending into the wire-receiving region. A wire of a cable extends into the wire-receiving region of the insulating insert and is electrically connected to the wire attachment portion of the contact member. A shielding body, including an insert-receiving region, has at least a portion of the insulating insert positioned in the insert-receiving region. An insulating cover covers at least a portion of the shielding body.

32 Claims, 4 Drawing Sheets

ELECTRICALLY SHIELDED CONNECTOR WITH OVER-MOLDED INSULATING COVER

FIELD OF THE INVENTION

The disclosures herein relate generally to electrical connectors and more particularly to electrically shielded connectors with over-molded insulating covers.

BACKGROUND

High speed electronic equipment, such as high-speed computer equipment and telecommunications equipment, often require the use of cable assemblies including shielded cables, shielded connectors or both. The space requirements for such equipment sometimes limit the physical size for the connectors or such cable assemblies. In these situations, a low profile shielded connector is often required.

An over-molding process is often used for forming the insulating cover of a low-profile shielded connector. The shielded connector includes a shielding body that can be inadvertently deformed during the over-molding process. Because the shielding body is conductive, deformation of the shielding body sometimes results in a short circuit between the shielding body and one or more of the electrical connections between the connector and the cable. Deformation of the shielding body also result in a conductor of the cable being unintentionally disconnected from a corresponding electrical contact of the connector. When such a short circuit or discontinuity exists, the cable assembly is defective, thus requiring it to be repaired or scrapped.

One conventional solution to limit deformation of the shielding body is to use a more robust shielding body in over-molded connector applications. The use of a more robust shielding body typically results in the shielding body being larger due to an increased wall thickness of the shielding body, due to structural features added to increase the strength of the shielding body or both. Increasing the size of the shielding body often precludes the corresponding connector from being used in applications in which a low-profile shielded connector is required.

Accordingly, a shielded connector with an over-molded insulating cover that is made in a manner that reduces the potential for shorting of the shielding body and or damaging the electrical connections in the shielding body without increasing the size of the connector is useful.

SUMMARY

One embodiment of a shielded cable assembly as disclosed herein includes a connector body including a wire attachment region. A contact member, including a wire attachment portion, is mounted on the connector body with the wire attachment portion positioned adjacent to the wire attachment region of the connector body. An insulating insert, including a wire-receiving region, is positioned adjacent to the connector body with at least a portion of the wire attachment region of the connector body extending into the wire-receiving region. A wire of a cable extends into the wire-receiving region of the insulating insert and is electrically connected to the wire attachment portion of the contact member. A shielding body, including an insert-receiving region, has at least a portion of the insulating insert positioned in the insert-receiving region. An insulating cover covers at least a portion of the shielding body.

DETAILED DESCRIPTION

Figure 1:
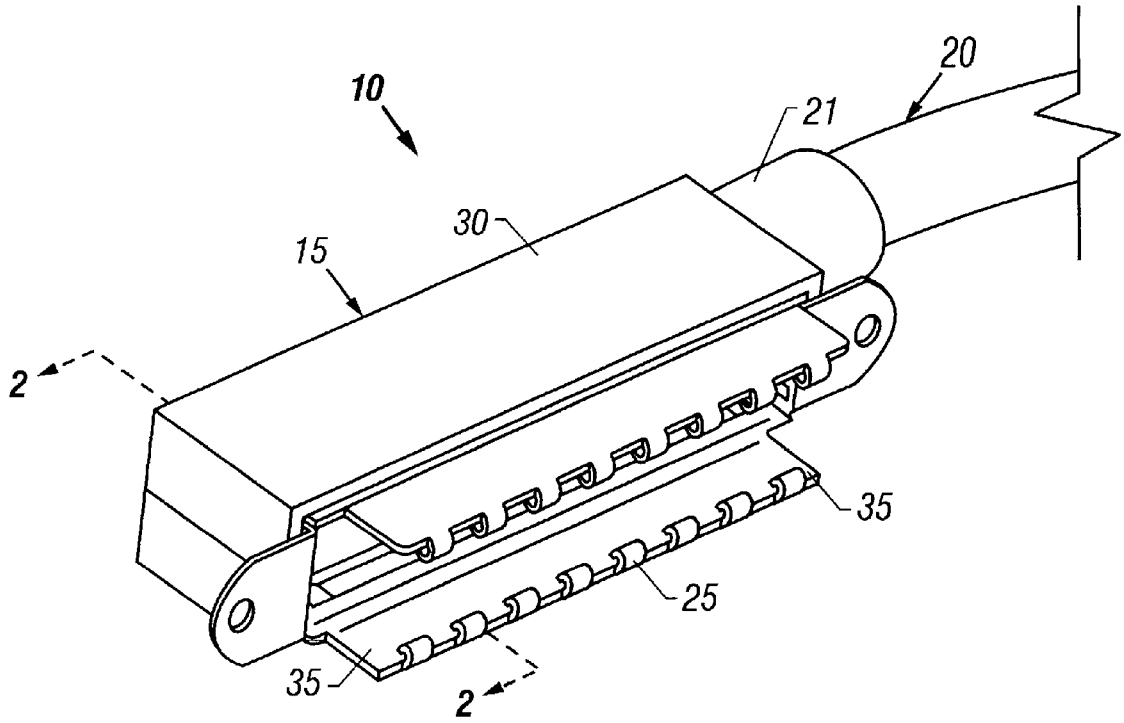
FIG. 1 is a perspective view depicting an embodiment of a shielded cable assembly.

An embodiment of a shielded cable assembly 10 is depicted in FIG. 1. The shielded cable assembly 10 includes a shielded connector assembly 15 electrically connected to a first end 21 of a shielded cable 20. The shielded cable assembly 10 may have another connector assembly, such as another shielded connector assembly 15, electrically connected at a second end thereof. The shielded connector assembly 15 includes a connector body 25 having an insulating cover 30 formed thereon. An over-molding operation is one example of a suitable technique for forming the insulating cover 30 on the connector body 25. The connector body 25 includes a plurality of contacts members 35 attached thereto. A connector assembly comprises the connector body 25 and the plurality of contact members 35.

Figure 2:
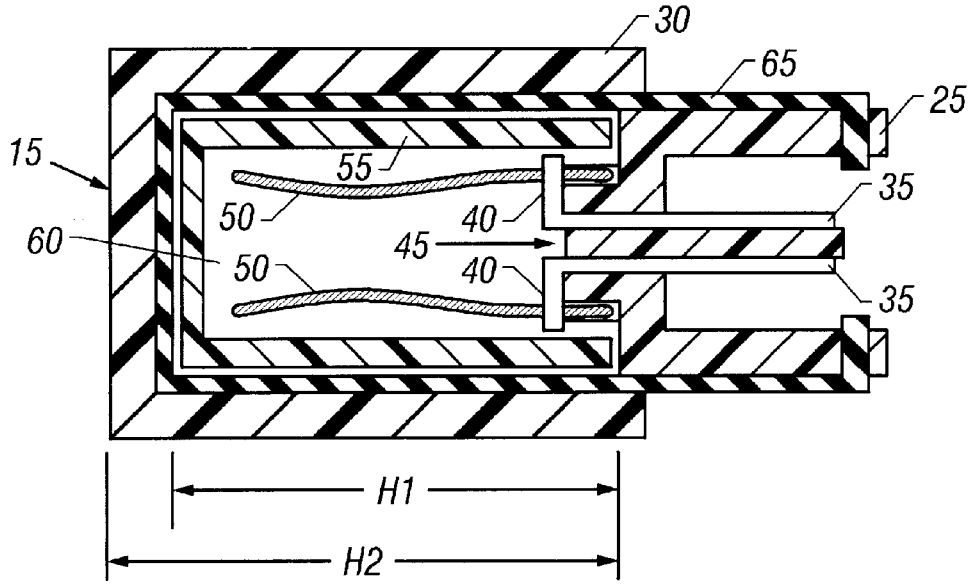
FIG. 2 is a cross sectional view taken along the line 2—2 in FIG. 1.

As depicted in FIG. 2, each one of the contact members 35 includes a wire attachment portion 40 adjacent to a wire attachment region 45 of the connector body 25. The wire attachment portion 40 of at least one of the contact members 35 has an insulated wire 50 attached thereto. An insulation displacement element is an example of the wire attachment portion 40.

The shielded connector assembly 15 includes an insulating insert 55. The wire attachment portion 40 of each one of the contact members 35 and the adjacent portion of each attached insulated wire 50 are positioned in a wire-receiving region 60 of the insulating insert 55. A cavity defined by the insulating insert is an example of the wire-receiving region 55. The insulating insert 55 is made from a non-conductive material such as a polymeric material. Nylon, polyethylene, polypropylene, and polyester are examples of suitable polymeric materials. The insulating insert 60 may be formed using a technique such as injection molding, extrusion, or any other suitable manufacturing technique.

Still referring to FIG. 2, the shielded connector assembly 15 includes a shielding body 65 for limiting adverse affects of electromagnetic interference (EMI). The shielding body 65 covers at least a portion of the connector body 25 and at least a portion of the insulating insert 55. It is advantageous for the shielding body 65 to cover a significant portion of the connector body 25 and the insulating insert 55. In this manner, the potential for adverse affects associated with EMI is reduced.

Figure 3:
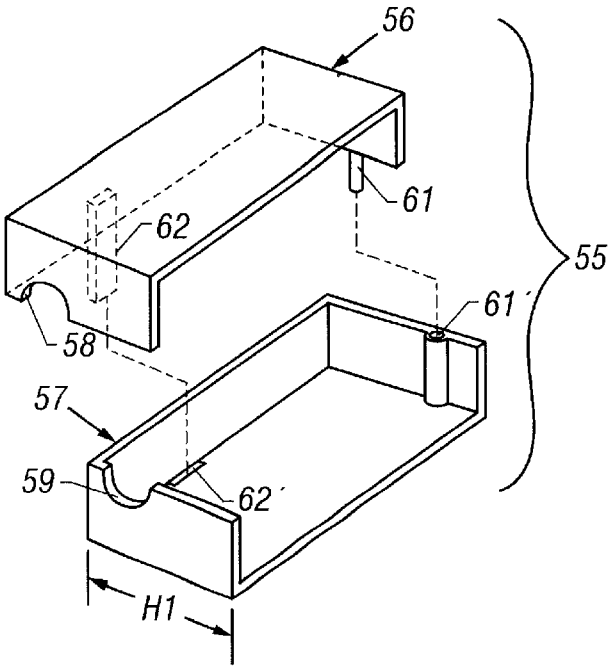
FIG. 3 is an exploded perspective view depicting an embodiment of a multi-piece insulating insert.

A multi-piece embodiment of the insulating insert 55 is depicted in FIG. 3. The multi piece embodiment of the insulating insert 55 includes a first insert member 56 and a second insert member 57. The first and the second insert members 56, 57 include respective wire-receiving port surfaces 58, 59. The first and the second insulating members 56, 57 are capable of being assembled over the wire attachment region 45 of the connector body 25. In this manner, the first and the second insulating members 56, 57 jointly define the wire-receiving region 60, FIG. 2, for receiving the wire attachment region 45 of the connector body 25 and the adjacent portion of the wire 50 attached to each one of the contact members 35. Furthermore, when the first and the second insulating members 56, 57 are assembled, one or more wires 50 of the cable 20, FIG. 1, passes through a wire-receiving port jointly defined by the wire-receiving port surfaces 58, 59.

The first insulating member 56 includes a first alignment member 61 that is received by a first mating alignment feature 61' of the second insulating member 56. The first insulating member 56 includes a second alignment member 62 that is received by a second mating alignment feature 62' of the second insulating member 56. The alignment members 61, 62 and the respective mating alignment features 61', 62' aid in maintaining alignment of the first insulating member 56 with the second alignment member 57.

Figure 4:
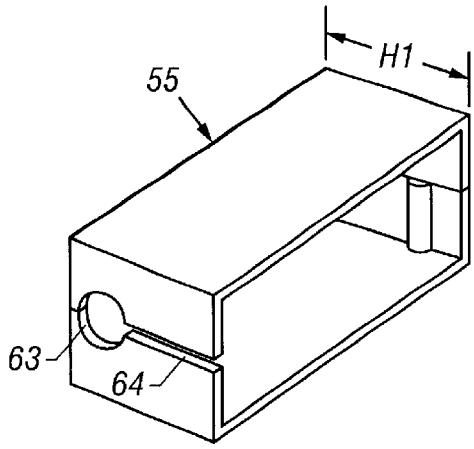
FIG. 4 is a perspective view depicting an embodiment of a one-piece insulating insert.

A one-piece embodiment of the insulating insert 55 is depicted in FIG. 4. The one piece embodiment of the insulating insert 55, as depicted in FIG. 4 has a wire-receiving port 63 and a wire insertion slot 64 for enabling one or more wires 50 of the cable 20, FIG. 1, to be positioned in the wire-receiving port 63. It is contemplated that the one-piece embodiment of the insulating insert 55 may be substantially the two-piece embodiment of the insulating member 55, depicted in FIG. 3, having a clam-shell type construction.

Figure 5:
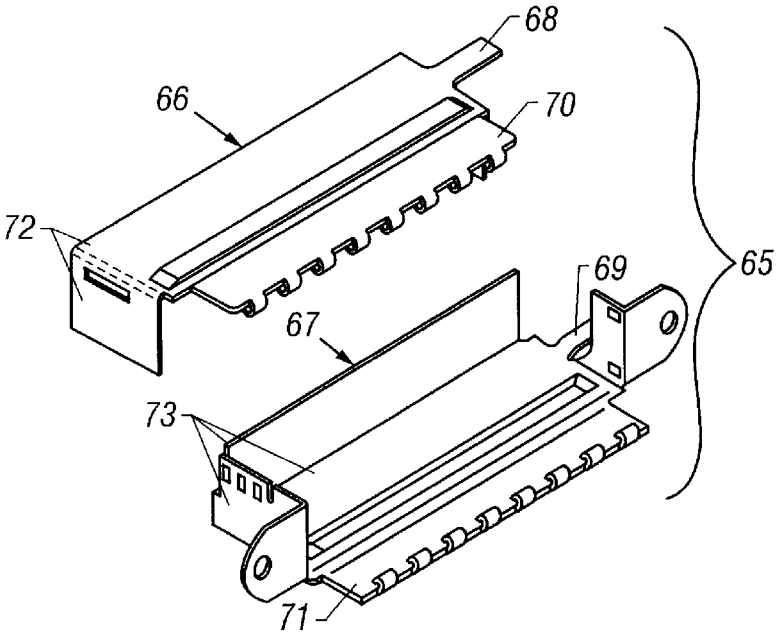
FIG. 5 is an exploded perspective view depicting an embodiment of a multi-piece shielding body.
Figure 6:
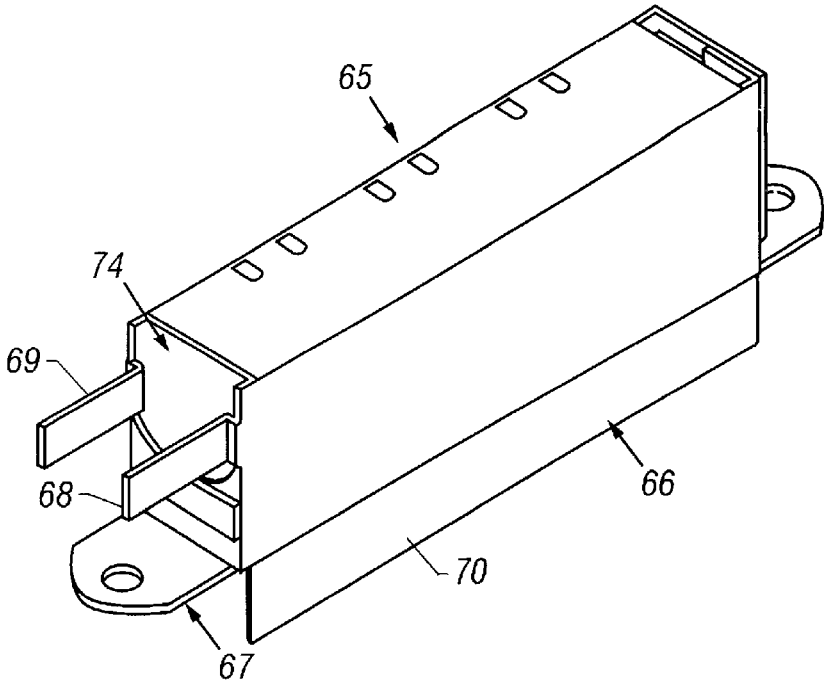
FIG. 6 is a perspective view depicting the shielding body depicted in FIG. 5 in an assembled configuration.

A multi-piece embodiment of the shielding body 65 is depicted in FIGS. 5 and 6. The shielding body 65 includes a first shielding member 66 and a second shielding member 67. The first and the second shielding members 66, 67 include respective cable grounding straps 68, 69, respective connector shielding portions 70, 71 and respective wire shielding portions 72, 73. The cable grounding straps 68, 69 are electrically connected to a shielding layer of the shielded cable 20, FIG. 1, for providing electrical continuity between the shielding body 65 and the shielding layer of the shielded cable 20.

The first and the second shielding members 66, 67 are capable of being assembled over the connector body 25 and the insulating insert 55. In this manner, the wire shielding portions 72, 73 form an insert-receiving region 74 for receiving the insulating insert 55 and the connector shielding portions 70, 71 cover at least a portion of the connector body 25. A cavity defined by the wire shielding portions 72, 73 of the shielding body 65 is an example of the insert-receiving region 74. It is contemplated that the shielding body 65 may be of a one-piece construction.

Figure 7:
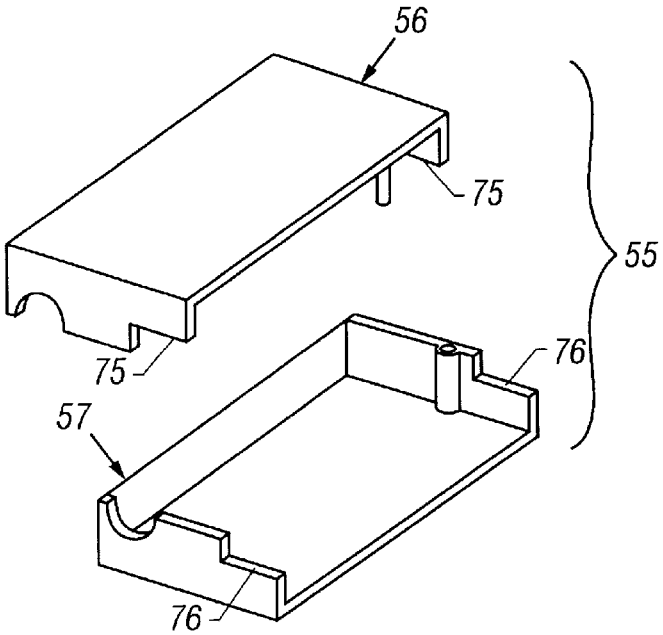
FIG. 7 is an exploded perspective view depicting an embodiment of an insulating insert having shut-off surfaces.
Figure 8:
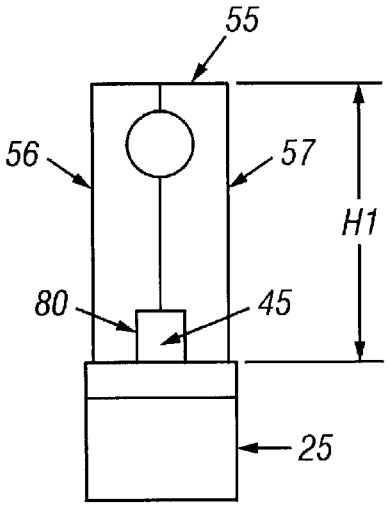
FIG. 8 is an end view depicting the insulating insert of FIG. 7 attached to a connector body.

FIGS. 7 and 8 depict an embodiment of the insulating insert 55 wherein the first and the second insulating members 56, 57 include respective shut-off surfaces 75, 76. The shut-off surfaces 75, 76 engage mating surfaces of the connector body 25, thus forming a shut-off interface 80, FIG. 8, between the insulating insert 55 and the connector body 25. In at least one embodiment, the shut-off surfaces 75, 76 engage mating surfaces defined by the wire attachment region 45 of the connector body 25.

The shut-off interface 80 is advantageous as it limits the flow of material into the wire-receiving region 60, FIG. 2, of the insulating insert 55 during formation of the insulating cover 30. In some instances, such as when the insulating cover 30 is formed by an injection molding process, the material that forms the insulating cover 30 is under extremely high pressure. Accordingly, it is desirable to limit the flow of the material that forms the insulating cover 30 into the wire-receiving region 60 such that the potential for shorting of the contact members 35 and/or damaging the electrical connections at the wire attachment portion 40 is reduced.

Figure 9:
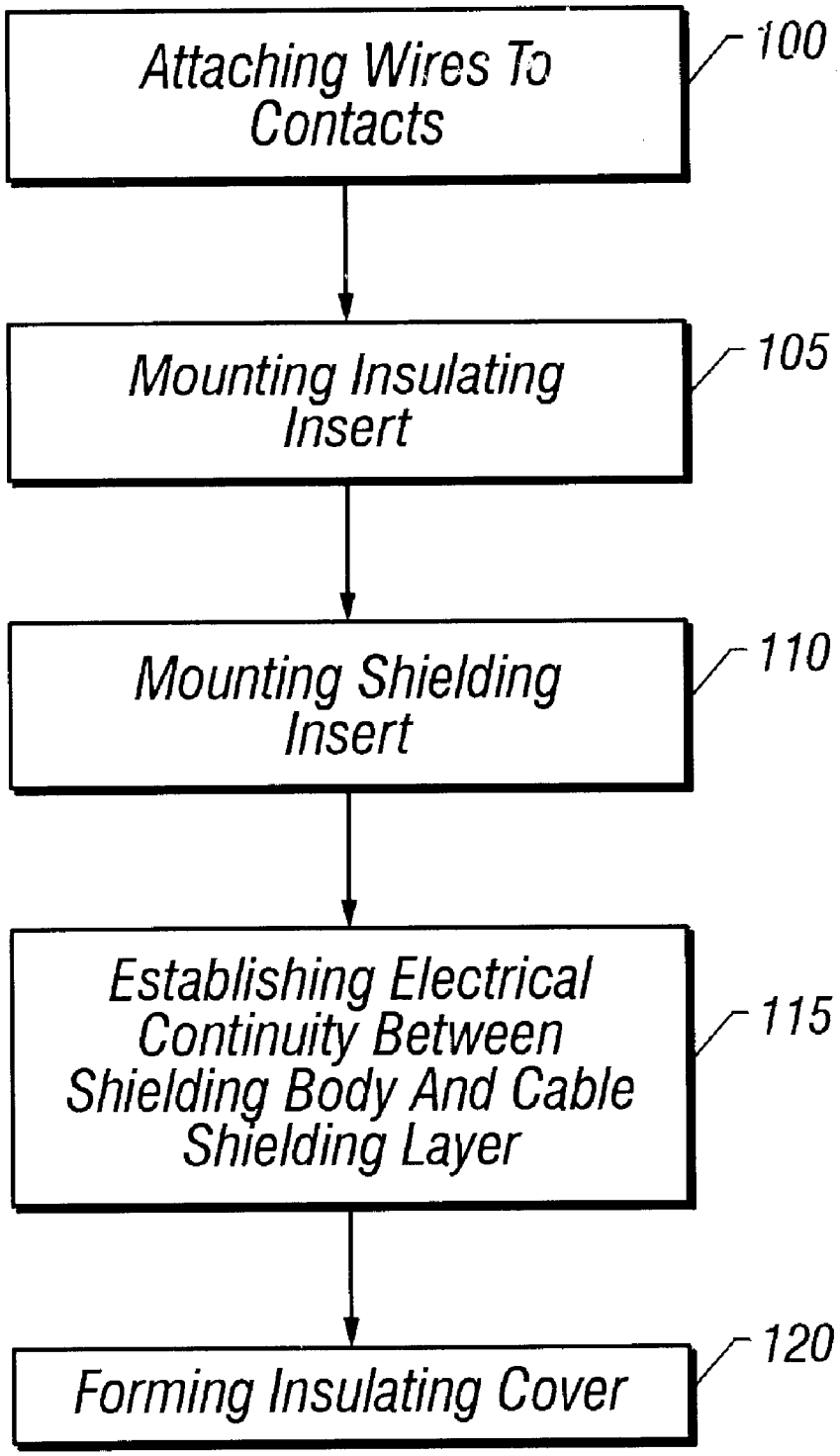
FIG. 9 is a flow chart view depicting an embodiment of a method for fabricating a shielded cable assembly as disclosed herein.

An embodiment of a method for forming the shielded cable assembly 10 is depicted in FIG. 9. An operation 100 is performed for attaching wires of a shielded cable to contacts of a connector assembly. An operation 105 is performed for mounting an insulating insert over the wires of the cable and over a wire attachment region of the connector body. An operation 110 is then performed for mounting a shielding body over the insulating insert and, in at least one embodiment, over at least a portion of the connector body. An operation 115 is performed for establishing electrical continuity between the shielding body and a shielding layer of the shielded cable. An operation 120 is then performed for forming the insulating cover.

A commercially available 50-position connector and commercially available shielding body, such as those available from Amp Incorporated, are examples of the connector body 25 and the shielding body 65, respectively. A CHAMP brand connector kit from Amp Incorporated includes a suitable commercially available connector and a suitable commercially available shielding body for fabrication a shielded connector assembly as disclosed herein. As discussed above, a suitable insulating insert may be fabricated using a process such as injection molding. A commercially available shielded cable, such as a 25-pair shielded cable from Prestolite Wire Corporation, is an example of the shielded cable 20.

The construction of the shielded connector assembly 15 disclosed herein is advantageous in applications where a shielded cable assembly including a low profile shielded connector assembly is desirable or required. A shielded cable assembly having a back-plane connector for Asymmetrical Digital Subscriber Line (ADSL) equipment is one example of an application where a shielded cable assembly including a low-profile shielded connector assembly is useful.

A low-profile shielding body is used in constructing a low-profile shielded connector assembly. A low-profile shielding body has at least one reduced dimension relative to a conventional profile shielding body. Reducing the height and/or overall size of the shielding body enables a low profile shielded connector assembly to be provided. However, reducing the height and/or overall size of the shielding body also reduces the clearance between the shielding body, contact members of the connector assembly, and wires connected to the contact members. In a conventional shielded connector assembly, the shielding body often deforms and/or moves during formation of the insulating cover, resulting in damage and/or shorting of the wires, contact members and electrical connections formed therebetween. The insulating insert disclosed herein advantageously reduces the potential for damage or shorting of the wires and contacts of the connector assembly.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical, mechanical, chemical and electrical changes may be made without departing from the spirit or scope of the invention. For example, functional blocks shown in the figures could be further combined or divided in any manner without departing from the spirit or scope of the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A shielded cable assembly, comprising:

a connector body including a wire attachment region;

a contact member including a wire attachment portion, the contact member being mounted on the connector body with the wire attachment portion positioned adjacent to the wire attachment region of the connector body;

an insulating insert including a cavity having an open end and a closed end, wherein the insulating insert is positioned adjacent to the connector body with at least a portion of the wire attachment portion of the contact member positioned within the cavity and wherein an insulating insert shut-off surface adjacent to the open end of the insulating insert is engaged with a mating shut-off surface of the connector body thereby defining a shut-off interface that limits the flow of an over-molded insulating cover material into the cavity during an over-molding operation;

a cable including a wire, the wire extending into the cavity of the insulating insert and being electrically connected to the wire attachment portion of the contact member;

a shielding body including an insert-receiving region, wherein at least a portion of the insulating insert is positioned in the insert-receiving region and at least a portion of the shielding body is mounted directly on the connector body; and an over-molded insulating cover covering at least a portion of the shielding body.

2. The shielded cable assembly of claim 1 wherein the insulating insert includes shut-off surfaces that engage mating surfaces of the connector body.

3. The shielded cable assembly of claim 2 wherein the mating surfaces of the connector body are at least partially defined by the wire attachment region of the connector body.

4. The shielded cable assembly of claim 1 wherein the insulating insert is mounted on the wire attachment region of the connector body.

5. The shielded cable assembly of claim 1 wherein the insulating insert includes a wire-receiving port extending therethrough, the wire extending through the wire-receiving port.

6. The shielded cable assembly of claim 5 wherein the insulating insert includes a wire insertion slot for enabling a wire to be inserted into the wire-receiving port.

7. The shielded cable assembly of claim 1 wherein the insulating insert is made of a non-conductive polymeric material.

8. The shielded cable assembly of claim 1 wherein the shielding body is a low-profile shielding body.

9. The shielded cable assembly of claim 1 wherein the shielding body overlays a significant portion of the insulating insert.

10. The shielded cable assembly of claim 1 wherein the insulating insert is a one-piece insulating insert.

11. The shielded cable assembly of claim 10 wherein the insulating insert is a multi-piece insulating insert.

12. The shielded cable assembly of claim 11 wherein the multi-piece insulating insert includes a first insulating member and a second insulating member.

13. The shielded cable assembly of claim 12 wherein the first insulating member includes an alignment member attached thereto and the second insulating member includes a mating alignment feature attached thereto, the alignment member capable of being engaged with the mating alignment feature when the first insulating member and the second insulating member are assembled over the wire attachment region of the connector body.

14. A shielded connector assembly kit, comprising:

a connector assembly including a connector body and a contact member mounted on the connector body, the contact member including a wire attachment portion positioned adjacent to a wire attachment region or the connector body;

an insulating insert including a cavity having an open end and a closed end, wherein the insulating insert capable of being mounted on the connector body with at least a portion of the wire attachment portion of the contact member positioned within the cavity and wherein an insulating insert shut-off surface adjacent to the open end of the insulating insert is engaged with a mating shut-off surface of the connector body thereby defining a shut-off interface that limits the flow of an over-molded insulating cover material into the cavity during an over-molding operation; and a shielding body including an insert-receiving region, wherein at least a portion of the insulating insert capable of being positioned in the insert-receiving region and at least a portion of the shielding body is mounted directly on the connector body.

15. The shielded connector assembly kit of claim 14 wherein the insulating insert includes shut-off surfaces that engage mating surfaces of the connector body.

16. The shielded connector assembly kit of claim 15 wherein the mating surfaces of the connector body are defined at least partially by the wire attachment region of the connector body.

17. The shielded connector assembly kit of claim 14 wherein the insulating insert includes a wire-receiving port extending therethrough.

18. The shielded connector assembly kit of claim 17 wherein the insulating insert includes a wire insertion slot for enabling a wire to be inserted into the wire-receiving port.

19. The shielded connector assembly kit of claim 14 wherein the insulating insert is made of a non-conductive polymeric material.

20. The shielded connector assembly kit of claim 14 wherein the shielding body is a low profile shielding body.

21. The shielded connector assembly kit of claim 14 wherein the shielding body overlays a significant portion of the insulating insert when the insulating insert is positioned in the insert-receiving region of the shielding body.

22. The shielded connector assembly kit of claim 14 wherein the insulating insert is a one-piece insulating insert.

23. The shielded connector assembly kit of claim 14 wherein the insulating insert is a multi-piece insulating insert.

24. The shielded connector assembly kit of claim 23 wherein the multi-piece insulating insert includes a first insulating member and a second insulating member.

25. The shielded connector assembly kit of claim 24 wherein the first insulating member includes an alignment member attached thereto and the second insulating member includes a mating alignment feature attached thereto, the alignment member capable of being engaged with the mating alignment feature when the first insulating member and the second insulating member are assembled over the wire attachment region of the connector body.

26. A method for fabricating a shielded cable assembly, comprising:

providing a connector including a connector body and a contact member mounted on the connector body, wherein the contact member includes a wire attachment portion positioned adjacent to a wire attachment region of the connector body;

electrically connecting a wire of a cable to the wire attachment portion of the contact member;

mounting an insulating insert including a cavity having an open end and a closed end on the connector body, wherein at least a portion of the wire attachment portion of the contact member is positioned within the cavity of the insulating insert, wherein the wire extends into the cavity of the insulating insert and wherein an insulating insert shut-off surface adjacent to the open end of the insulating insert is engaged with a mating shut-off surface of the connector body thereby defining a shut-off interface that limits the flow of an over-molded insulating cover material into the cavity during an over-molding operation;

mounting a shielding body jointly on the insulating insert and the connector body, wherein at least a portion of the insulating insert is positioned in an insert-receiving region of the shielding body region and at least a portion of the shielding body is mounted directly on the connector body; and over-molding an insulating cover over at least a portion of the shielding body.

27. The method of claim 26 wherein mounting the insulating insert on the connector body includes engaging shut-off surfaces of the insulating insert with mating surfaces of the connector body.

28. The method of claim 26 wherein mounting the insulating insert on the connector body includes extending the wire through a wire-receiving port of the insulating insert.

29. The method of claim 28 wherein extending the wire through the wire-receiving port includes passing the wire through a wire insertion slot of the insulating insert.

30. The method of claim 26 wherein forming an insulating cover includes molding the insulating cover.

31. The method of claim 26, further comprising:

establishing electrical continuity between the shielding body and a shielding layer of the cable.

32. A shielded cable assembly, comprising:

a connector including a connector body and a plurality of contact members mounted on the connector body, wherein each one of said contact members includes a wire attachment portion positioned adjacent to a wire attachment region of the connector body;

an insulating insert including a cavity having an open end and a closed end, wherein the insulating insert is positioned adjacent to the connector body with at least a portion of the wire attachment portion of the contact member positioned within the cavity and wherein an insulating insert shut-off surface adjacent to the open end of the insulating insert is engaged with a mating shut-off surface of the connector body thereby defining a shut-off interface that limits the flow of an over-molded insulating cover material into the cavity during an over-molding operation;

a cable including a plurality of wires and a shielding layer around said wires, the plurality of wires extending into the cavity of the insulating insert and each one of said wires being electrically connected to the wire attachment portion of a corresponding one of said contact members;

a shielding body including an insert-receiving region and having electrical continuity with the shielding layer of the cable, wherein at least a portion of the insulating insert positioned in the insert-receiving region and at least a portion of the shielding body is mounted directly on the connector body; and an over-molded insulating cover covering at least a portion of the shielding body.

* * * * *